US007293440B2

(12) United States Patent
Horikawa et al.

(10) Patent No.: US 7,293,440 B2
(45) Date of Patent: Nov. 13, 2007

(54) METHOD OF SETTING/CONTROLLING WEDGE IN PLATE MATERIAL ROLLING

(75) Inventors: Tokujiro Horikawa, Tokyo (JP); Kazuyuki Maruyama, Tokyo (JP); Minoru Choka, Tokyo (JP); Masaru Miyokawa, Tokyo (JP); Yoshiharu Ambe, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 30 days.

(21) Appl. No.: 10/569,083

(22) PCT Filed: Jul. 20, 2004

(86) PCT No.: PCT/JP2004/010311

§ 371 (c)(1),
(2), (4) Date: Feb. 21, 2006

(87) PCT Pub. No.: WO2006/008808

PCT Pub. Date: Jan. 26, 2006

(65) Prior Publication Data

US 2006/0207305 A1 Sep. 21, 2006

(51) Int. Cl.
*B21B 37/00* (2006.01)

(52) U.S. Cl. ..... 72/9.3; 72/9.1; 72/9.2; 72/11.7; 72/11.8

(58) Field of Classification Search ..... 700/148, 700/150, 154, 155, 156; 72/160, 241.8
See application file for complete search history.

(56) References Cited

U.S. PATENT DOCUMENTS 3,882,709 A * 5/1975 Kawamoto et al. ..... 72/234
4,485,497 A * 12/1984 Miura ..... 700/152
5,126,947 A * 6/1992 Koyama ..... 700/154
5,267,170 A * 11/1993 Anbe ..... 700/154
5,493,885 A * 2/1996 Nomura et al. ..... 72/9.1
5,495,735 A * 3/1996 Nishimura ..... 72/8.2
5,546,779 A * 8/1996 Ginzburg ..... 72/11.4
5,860,304 A * 1/1999 Anbe et al. ..... 72/9.1
6,161,405 A * 12/2000 Anbe et al. ..... 72/9.1

FOREIGN PATENT DOCUMENTS

JP 02025210 A * 1/1990
JP 4-9206 1/1992
JP 2000-94023 4/2000
JP 2002-210513 7/2002

OTHER PUBLICATIONS

Machine generated translation of JP 2002-210513.*

* cited by examiner

*Primary Examiner*—Dmitry Suhol
(74) *Attorney, Agent, or Firm*—Leydig, Voit & Mayer, Ltd.

(57) ABSTRACT

A wedge setup/control method for plate material rolling ensures that the work side and drive side are equal in the rolled plate thickness. The wedge setup/control method, which is used in reversible rolling of a plate material with a rough mill for hot rolling, includes preparing a wedge meter on the outlet side of the rough mill to measure the plate thickness in the direction of the plate width; performing calculations on a wedge measured by the wedge meter, using the influence coefficient of the wedge for roll gap leveling of the rough mill; determining amount of roll gap leveling control; and exercising feedback control to apply the amount of roll gap leveling control to the roll gap leveling of the rough mill.

6 Claims, 2 Drawing Sheets

METHOD OF SETTING/CONTROLLING WEDGE IN PLATE MATERIAL ROLLING

TECHNICAL FIELD

The present invention relates to a wedge setup/control method for rolling of a metal or other plate material.

BACKGROUND ART

In the rolling of a metal or other material, particularly in the rolling of a plate material, it was conventionally demanded that the wedge (thickness variation in the direction of the plate width) be eliminated. More specifically, it was demanded that the plate thickness on the work side be equal to the plate thickness on the drive side. Formerly, while there was no plate material after mill roll replacement, the roll gap was reduced by a force, for instance, of 1000 or 1500 tons to ensure that the same rolling force is applied to the work side and drive side.

In general, however, the rolled plate varied in plate thickness. More specifically, the plate thickness on the work side differed from the plate thickness on the drive side. This plate thickness difference was caused, for instance, by the difference of a mill elastic constant in a mill housing between the work side and load side, the mill hysteresis difference between the work side and load side, or the slab plate thickness between the work side and drive side.

A conventional technology disclosed, for instance, by Patent Document 1 uses a wedge measuring instrument, which is installed at the outlet side or inlet side of a rolled material, to measure the amount of wedge. When the wedge is measured on the outlet side, this technology exercises feedback control in accordance with the measured amount of wedge. When the wedge is measured on the inlet side, this technology exercises feed forward control while using the load differential between the right- and left-hand sides of a roll and the load applied to a side guide. In this manner, this technology simultaneously suppresses the camber and wedge (refer to Patent Document 1, for example).

[Patent Document 1]

Japanese Patent Laid-Open No. 210513/2002

DISCLOSURE OF THE INVENTION

Problem to be Solved by the Invention

It seems that there was few positive setup/control method for providing the work side and drive side with the same plate thickness in plate material rolling. If the wedge is great particularly in plate material rolling, it is difficult to continue with rolling, and the dimensional error of a rolled plate or other problem may arise.

Means for Solving the Problem

The present invention, which is used in reversible rolling of a plate material with a rough mill for hot rolling, said method comprising the steps of:

preparing a wedge meter on the outlet side of the rough mill to measure the plate thickness in the direction of the plate width;

performing calculations on the wedge measured by the wedge meter by using the influence coefficient of a wedge for roll gap leveling of the rough mill;

determining the amount of roll gap leveling control; and exercising feedback control to apply the amount of roll gap leveling control to the roll gap leveling of the rough mill.

Effect of the Invention

The present invention, which is outlined above, can roll a plate in such a manner that the plate thickness on the work side is equal to the plate thickness on the drive side. A rolling operation can be normally performed because no plate camber or plate skew is encountered during rolling. Further, a take-up operation can be normally performed by a take-up device on the finishing mill outlet side. In addition, subsequent processes such as a cold rolling process can be smoothly performed because the plate thickness in the direction of the plate width is uniform. Furthermore, the accuracy of a product made of a plate material produced by the use of the present invention is increased because a uniform plate thickness is provided in the direction of the plate width.

BEST MODE FOR CARRYING OUT THE INVENTION

The method and apparatus for wedge setup/control in plate rolling will now be described. As an example, a hot strip mill for slab hot rolling will be described below.

First Embodiment

Figure 1:
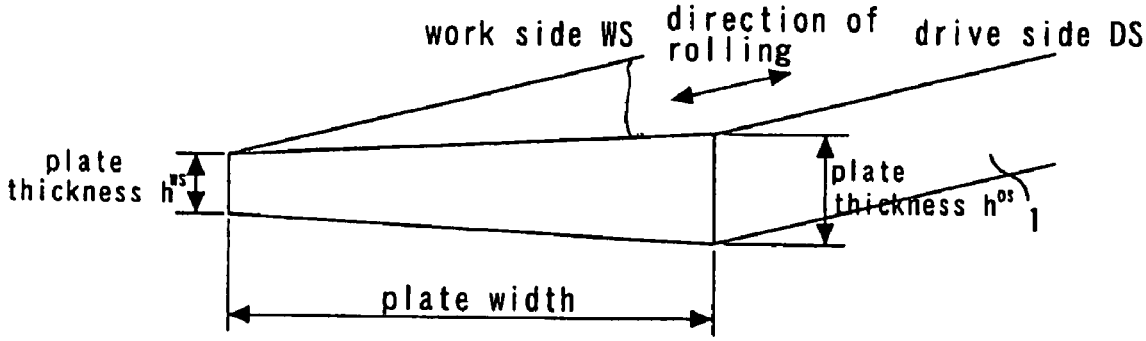
FIG. 1 illustrates the shape of a wedge.

FIG. 1 illustrates the shape of a wedge. The wedge is a plate thickness difference in the direction of the plate width between the work side and drive side. That is, the wedge is defined by the following equation:

$$\Delta W = h^{WS} - h^{DS} \qquad \text{Equation (1)}$$

where ΔW is the wedge, $h^{WS}$ is the plate thickness on the work side, and $h^{DS}$ is the plate thickness on the drive side.

Figure 2:
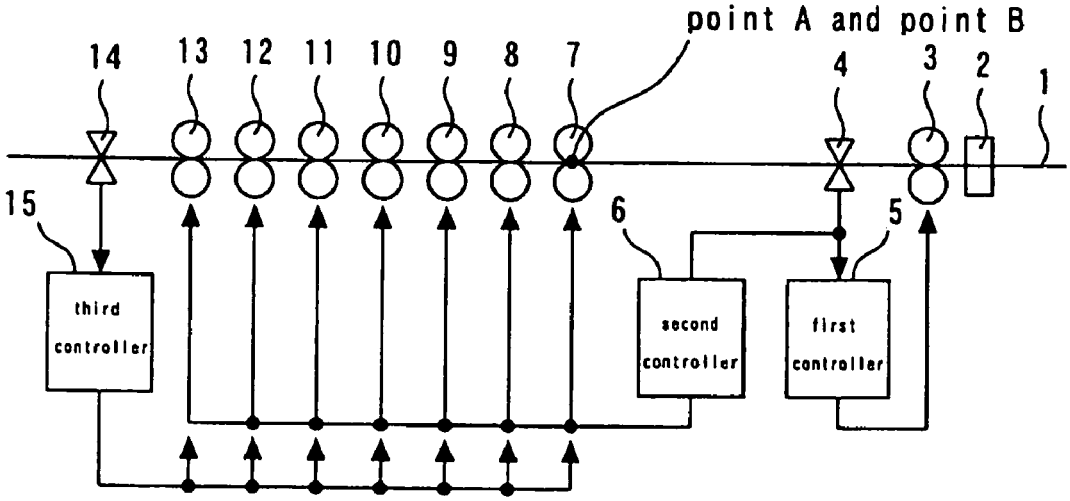
FIG. 2 is a system configuration diagram that schematically shows an overall configuration example of wedge setup/control according to the present invention.

FIG. 2 is a system configuration diagram that schematically shows an overall configuration example of wedge setup/control according to the present invention. A rolled slab 1 weighs 10 to 50 tons (or as much as 150 tons). It is heated and generally reversible rolled (or unidirectionally rolled) by rough mills 2, 3. In FIG. 2, the reference numeral 2 denotes an attached edger; 3, a horizontal mill, which is a rough mill; 4, a first wedge meter; 5, a first controller for roll gap leveling control of the horizontal mill 3; 6, a second controller; 7 to 13, first to seventh stands, which are finishing mills; 14, a second wedge meter; and 15, a third controller.

The wedge meters 4, 14 measure the plate thickness with X-rays or gamma rays. In some cases, a sensor is moved in the direction of the plate width for measurement purposes. In some other cases, many sensors and detectors are used for measurement purposes.

In general, the plate thickness distribution in the direction of the plate width is measured. The plate thicknesses ($h^{WS}$ and $h^{DS}$) on the work side and drive side are then measured by subjecting the measured plate thickness distribution to approximation by using, for instance, a polynomial expression. Further, the plate thickness at the center of the plate width is measured.

A first wedge setup/control method according to the present invention relates to wedge feedback control in the rough mills 2, 3. In rolling in the direction from the attached edger 2 to the horizontal mill 3 (odd-numbered pass), the wedge is measured on the rolling outlet side to exercise roll gap leveling control over the horizontal mill 3.

Figure 3:
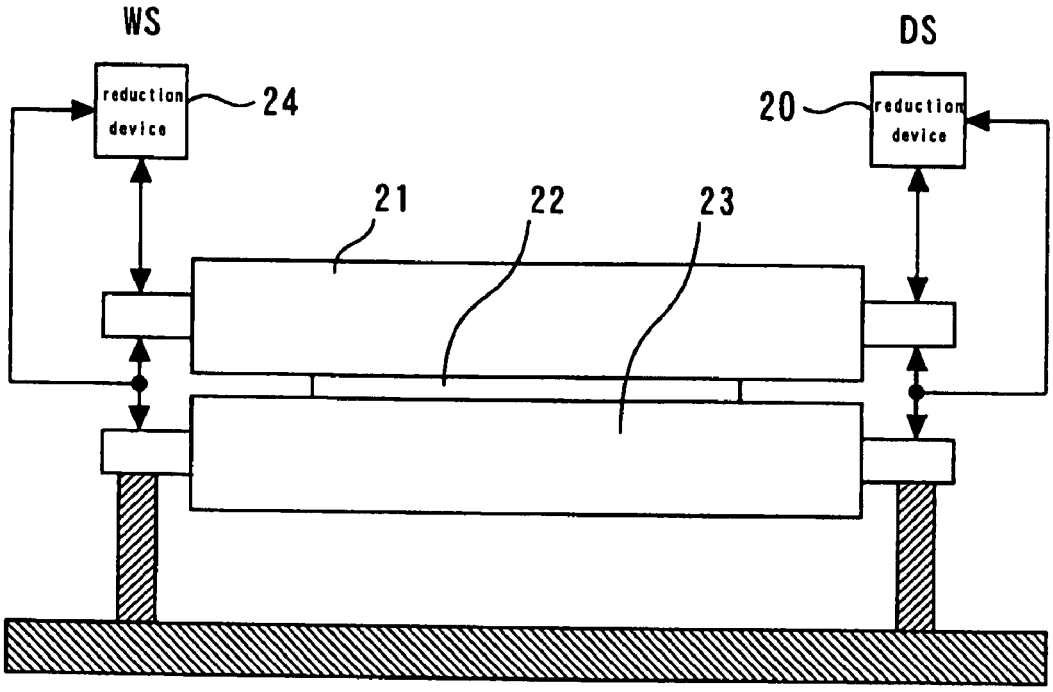
FIG. 3 is rolling mills (horizontal mill and finishing mills), are generally configured.

The horizontal mill 3 and finishing mills 7 to 13, which are rolling mills, are generally configured as shown in FIG. 3. The reference numerals 21 and 23 denote mill rolls. The reference numeral 22 denotes a plate to be rolled. The reference numeral 20 denotes a reduction device that is hydraulically or electrically driven to provide roll gap control over the roll drive side. The reference numeral 24 denotes the same hydraulically or electrically driven reduction device for exercising roll gap control over the roll work side.

Figure 4:
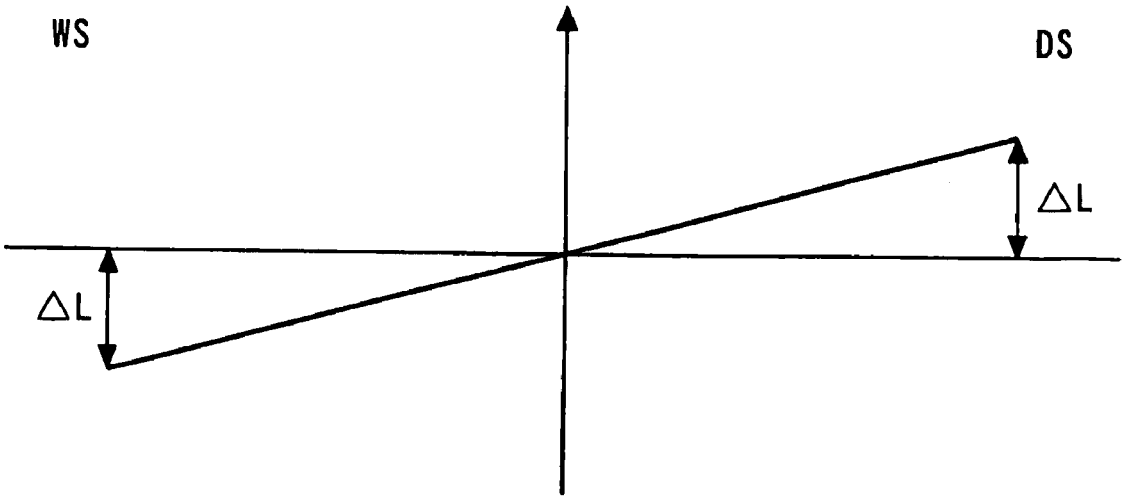
FIG. 4 is a roll gap leveling diagram that illustrates a situation where the drive side is opened by ΔL mm with the work side closed by ΔL mm.

FIG. 4 is a roll gap leveling diagram that illustrates a situation where the drive side is opened by ΔL mm with the work side closed by ΔL mm.

When the first wedge setup/control method is employed, the first controller 5, which is shown in FIG. 2, operates as indicated below:

$$\frac{\partial W}{\partial L}\Delta L = \Delta W \qquad \text{Equation (2)}$$

The following equation is then obtained from the above equation:

$$\Delta L = \frac{\Delta W}{\left(\frac{\partial W}{\partial L}\right)} \qquad \text{Equation (3)}$$

In accordance with the above equation, the first wedge meter 4 is used to measure the wedge on the rolling outlet side and adjust the roll gap leveling value ΔL of the horizontal mill 3. ΔW is the measured wedge that is derived from Equation (1).

$$\frac{\partial W}{\partial L}$$

is the wedge influence coefficient for the roll gap leveling value ΔL. It can be otherwise calculated with a rolling schedule given or can be actually measured.

Control according to Equation (3) is provided by exercising successive integral control over the wedge measured by the wedge meter 4 shown in FIG. 2 or by exercising on time/off time control in which a process for measuring the result of the control provided by the horizontal mill 3 with the wedge meter 4 and exercising control with the horizontal mill 3 is repeated. In this manner, wedge control can be exercised over the whole length in an odd-numbered pass.

Second Embodiment

A second wedge setup/control method according to the present invention relates to wedge feed forward control in the rough mills 2, 3. In rolling in the direction from the attached edger 2, which is shown in FIG. 2, to the horizontal mill 3 (odd-numbered pass), the wedge is measured with the first wedge meter 4 on the outlet side in accordance with the distance from the leading end and then stored. The measured wedge is referred to as ΔW(x) (x: distance from the plate's leading end). At the same time, the outlet side plate thickness at the center of the plate is measured and stored. The measured outlet side plate thickness is referred to as H(x). Next, in rolling in the direction from the horizontal mill 3 to the attached edger 2 (even-numbered pass), the mill setting calculation plate thickness on the outlet side is referred to as h. Tracking is performed with the stored measured ΔW(x) and H(x) regarded as an inverse pass. When the plate engages with the horizontal mill 3, the first controller 5, which is shown in FIG. 2, operates as indicated below:

$$\frac{h}{H(x)}\Delta W(x) = \frac{\partial W}{\partial L}\Delta L(x) \qquad \text{Equation (4)}$$

The following equation is then obtained from the above equation:

$$\Delta L(x) = \frac{1}{\left(\frac{\partial W}{\partial L}\right)}\frac{h}{H(x)}\Delta W(x) \qquad \text{Equation (5)}$$

In accordance with the above equation, the roll gap leveling value ΔL(x) for the horizontal mill 3 is controlled.

$$\frac{\partial W}{\partial L}$$

is the influence coefficient of roll gap leveling in an even-numbered pass for the wedge.

An alternative is to measure the inlet side plate thickness H(x) and inlet side wedge ΔW(x) at the center of the plate thickness in an even-numbered pass by using the wedge meter on the inlet side, provide a delay until the horizontal mill 3 is encountered, and apply the values to Equations (4) and (5).

Third Embodiment

A third wedge setup/control method according to the present invention relates to feed forward control that is exercised between the rough mill outlet side and finishing mills. On the outlet side of the rough mill final pass (odd-numbered pass, rolling in the direction from the attached edger 2 to the horizontal mill 3), the plate thickness $h^{TB}(x)$ at the center of the plate width and the wedge $\Delta W^{TB}(x)$ are measured in accordance with the distance x from the plate leading end and then stored. TB stands for a transfer bar. These stored values are stored in the second controller 6, which is shown in FIG. 2. Further, the following calculations are performed.

The present invention is characterized by the fact that the following relationship prevails on the outlet side of the finishing mill i-th stand:

$$\Delta W_i = \eta_i \Delta W_{i-1} + \left(\frac{\partial W}{\partial L}\right)_i \Delta L_i \quad \text{Equation (6)}$$

where $\eta_i$ is a wedge inheritance coefficient. If a rolling schedule is given, this coefficient can be separately calculated. It can also be determined on an experimental basis. The first term on the right side of Equation (6) is an element to which the wedge of the upstream stand (that is, the inlet side) is inherited. The second term on the right side of Equation (6) is an element that is controlled according to the stand's roll gap leveling value. When Equation (6) is expressed by the distance x between the transfer bar and plate leading end, the following equation is obtained:

$$\Delta W_i(x) = \eta_i(x) \Delta W_{i-1}(x) + \left(\frac{\partial W}{\partial L}\right)_i \Delta L_i(x) \quad \text{Equation (7)}$$

As shown in FIG. 2, the finishing mills according to the present invention are represented by the first to seventh stands 7 to 13. Therefore, the value i in Equations (6) and (7) is between 1 and 7. For various stands of the finishing mills, the following equations are derived from Equation (7):

$$\Delta W_1(x) = \eta_1 \Delta W^{TB}(x) + \left(\frac{\partial W}{\partial L}\right)_1 \Delta L_1(x) \quad \text{Equation (8-1)}$$

$$\Delta W_2(x) = \eta_2 \Delta W_1(x) + \left(\frac{\partial W}{\partial L}\right)_2 \Delta L_2(x) \quad \text{Equation (8-2)}$$

$$\Delta W_3(x) = \eta_3 \Delta W_2(x) + \left(\frac{\partial W}{\partial L}\right)_3 \Delta L_3(x) \quad \text{Equation (8-3)}$$

...

$$\Delta W_6(x) = \eta_6 \Delta W_5(x) + \left(\frac{\partial W}{\partial L}\right)_6 \Delta L_6(x) \quad \text{Equation (8-6)}$$

$$\Delta W_7(x) = \eta_7 \Delta W_6(x) + \left(\frac{\partial W}{\partial L}\right)_7 \Delta L_7(x) \quad \text{Equation (8-7)}$$

A characteristic strategy of the present invention uses the following equation:

$$\frac{\Delta W^{TB}(x)}{h^{TB}(x)} = \frac{\Delta W_i(x)}{h_i(x)} G_i \quad (i = 1 \sim 7) \quad \text{Equation (9)}$$

where $h_i(x)$ is a plate thickness at the center of the plate. In FIG. 1 in which a conventional method is shown, this plate thickness is given by a mill setting calculation (not shown). $G_i$ is a gain.

The following equation is obtained from Equation (9):

$$\Delta W_i(x) = \frac{\Delta W^{TB}(x)}{h^{TB}(x)} \frac{h_i(x)}{G_i} \quad (i = 1 \sim 7) \quad \text{Equation (10)}$$

The above equation is substituted into the left sides of Equations (8-1) to (8-7).

Since $\Delta W^{TB}(x)$ in Equation (8-1) is known, $\Delta L_1(x)$ is determined. When $\Delta W_1(x)$ in Equation (8-1) is substituted into Equation (8-2), $\Delta L_2(x)$ is determined. In the same manner, $\Delta L_1(x)$ is determined from Equation (8-1). In FIG. 2, from right to left, the finishing mills are the first stand 7, the second stand 8, and so on to the seventh stand 13. The symbol i in the above equation represents a stand number. The roll gap leveling amount $\Delta L_i(x)$, which is determined as described above, is applied to the first to seventh stands 7 to 13 by performing tracking over the distance x with the second controller 6, which is shown in FIG. 2. In other words, the same point at the distance x is subjected to tracking. For various stands 7 to 13, the control output is applied to the same point.

An alternative is to determine the average values of the plate thickness $h^{TB}(x)$ at the plate center on the rough mill outlet side and of the wedge $\Delta W^{TB}(x)$ over the whole length, subject the obtained average values to calculations according to Equations (8-1), (8-2), and (10), and apply the calculation results to the roll gap leveling values of the first to seventh stands 7 to 13 before rolling of the finishing mills. Transfer bar tracking is not required, and control is exercised only once.

Fourth Embodiment

A fourth wedge setup/control method according to the present invention relates to wedge feedback control that is exercised between the finishing mill side second wedge meter 14 and the third controller 15. When the plate leading end reaches the second wedge meter 14, the second wedge meter 14 measures the wedge $\Delta W_1^{MEAS}$. Further, the plate thickness $h_i$ (i=1 to 7) at the center of the plate width on the outlet side of each stand is input into the third controller 15 from the mill setting calculation (not shown). The second wedge meter 14 is the same as the first wedge meter 4.

The present invention is characterized by the fact that Equation (6) is used. In other words, the third controller 15 uses the following relationships for various stands 7 to 13:

$$\Delta W_1 = \eta_1 \Delta W_0 + \left(\frac{\partial W}{\partial L}\right)_1 \Delta L_1 \quad \text{Equation (11-1)}$$

$$\Delta W_2 = \eta_2 \Delta W_1 + \left(\frac{\partial W}{\partial L}\right)_2 \Delta L_2 \quad \text{Equation (11-2)}$$

$$\Delta W_3 = \eta_3 \Delta W_2 + \left(\frac{\partial W}{\partial L}\right)_3 \Delta L_3 \quad \text{Equation (11-3)}$$

$$\Delta W_6 = \eta_6 \Delta W_5 + \left(\frac{\partial W}{\partial L}\right)_6 \Delta L_6 \quad \text{Equation (11-6)}$$

$$\Delta W_7 = \eta_7 \Delta W_6 + \left(\frac{\partial W}{\partial L}\right)_7 \Delta L_7 \quad \text{Equation (11-7)}$$

The first term $\Delta W_0$ of the right side of Equation (11-1) is a transfer bar wedge. However, the value 0 (zero) is used for $\Delta W_0$.

Further, the present invention is also characterized by the fact that the following control strategy is used:

$$\alpha_i \frac{\Delta W_i}{h_i} = \frac{\Delta W_7}{h_7} \quad (i = 1 \sim 7) \quad \text{Equation (12)}$$

where $\alpha_i$ is a gain.

$$\Delta W_7 = \Delta W_7^{MEAS} \quad \text{(Equation 13)}$$

When the above equation is true, the following equation is obtained from Equation (12):

$$\Delta W_i = \frac{h_i}{\alpha_i}\frac{\Delta W_7^{MEAS}}{h_7} \quad (i = 1 \sim 7) \qquad \text{Equation (14)}$$

When the above equation is substituted into the left sides of Equations (11-1) to (11-7), the following equation is obtained from Equation (11-1):

$$\Delta L_1 = \frac{\Delta W_1}{\left(\frac{\partial W}{\partial L}\right)_1} \qquad \text{Equation (15-1)}$$

The above equation determines the roll gap leveling control amount for the first stand 7. Further, when $\Delta W_1$ in Equation (11-1) is substituted into Equation (11-2), the following equation is obtained:

$$\Delta L_2 = \frac{\Delta W_2 - \eta_2 \Delta W_1}{\left(\frac{\partial W}{\partial L}\right)_2} \qquad \text{Equation (15-2)}$$

The above equation determines the roll gap leveling control amount for the second stand 8. In the same manner, the roll gap leveling control amount for each stand is calculated. For the seventh stand 13, the following equation is obtained:

$$\Delta L_7 = \frac{\Delta W_7 - \eta_7 \Delta W_6}{\left(\frac{\partial W}{\partial L}\right)_7} \qquad \text{Equation (15-7)}$$

The roll gap leveling control amounts $\Delta L_i$ (i=1 to 7), which have been determined as described above for the finishing mill stands 7 to 13, are applied to the stands as described below. The present invention uses two application methods.

The first method provides single-point control. First of all, $\Delta L_1$ is applied to the first stand 7, which is shown in FIG. 2. On-plate point A to which $\Delta L_1$ is applied is then tracked. When point A reaches the second stand 8, $\Delta L_2$ is applied. In the same manner, point A is tracked at each stand and the roll gap leveling control amount is applied. Finally, $\Delta L_7$ is applied to the seventh stand 13. When point A reaches the second wedge meter 14 on the finishing mill outlet side, the second wedge measurement starts. After completion of the second wedge measurement, the same control is exercised as the first one. Control is repeatedly exercised until the plate entirely passes through the finishing mill.

The second method provides simultaneous control. As the first control, the roll gap leveling control amounts $\Delta L_i$ (i=1 to 7), which are determined by Equations (15-1) to (15-7), are simultaneously applied to the first to seventh stands 7 to 13. Point B, which exists at the first stand 7 at the time of the first control, is tracked. When point B reaches the second wedge meter 14 on the finishing mill outlet side, the wedge is measured again. Calculations are performed in the same manner as for the first control. The roll gap leveling control amounts $\Delta L_i$ (i=1 to 7) are then simultaneously applied to the finishing mill stands. In the same manner as mentioned above, control is repeatedly exercised until the plate entirely passes through the finishing mill.

Fifth Embodiment

A fifth wedge setup/control method according to the present invention uses the second wedge meter 14 on the finishing mill outlet side, which is shown in FIG. 2, and the third controller 15. This method provides bar-to-bar learning setup and is used when the fourth embodiment of the present invention is not implemented.

Wedge measurements are made over the whole length with the second wedge meter 14 and then averaged. The obtained average value is referred to as $\Delta W_7^{AVERAGE}$. The following equation is obtained in relation to $\Delta W_7^{MEAS}$, which is used with the method according to the fourth embodiment:

$$\Delta W_7^{MEAS} = \Delta W_7^{AVERAGE} \qquad \text{Equation (16)}$$

The same calculations are then performed as described in conjunction with the method according to the fourth embodiment to determine the finishing mill roll gap leveling control amounts $\Delta L_i$ (i=1 to 7) for the whole length. The values $\Delta L_i$ (i=1 to 7) are set to the first to seventh stands 7 to 13 before rolling of the next plate. In other words, this provides bar-to-bar setup.

INDUSTRIAL APPLICABILITY

As described above, the wedge setup/control method according to the present invention, which is used for rolling of metal or the like, ensures that the rolled plate thickness on the work side is equal to the one on the drive side. Thus, rolling operations are normally performed because no plate camber or plate skew occurs during rolling. In addition, subsequent processes such as a cold rolling process can be smoothly performed because the plate thickness in the direction of the plate width is uniform. Further, the accuracy of a product made of a plate material produced by the use of the present invention is increased because a uniform plate thickness is provided in the direction of the plate width.

The invention claimed is:

1. A wedge setup/control method for plate material rolling, which is used in reversible rolling of a plate material with a rough mill for hot rolling, said method comprising:

preparing a wedge meter on an outlet side of a rough mill to measure plate thickness in the direction of the plate width;

measuring, in an odd-numbered pass rolling of the rough mill, a wedge and the plate thickness at the center of the plate width with the wedge meter, in accordance with distance from the plate leading end, and storing the measured values;

calculating, in an even-numbered pass rolling, a wedge influence coefficient for roll gap leveling and outlet side plate thickness with the wedge meter in accordance with distance from the plate leading end;

determining amount of roll gap leveling control; and exercising feed forward control to apply the amount of the roll gap leveling control to roll gap leveling of the rough mill.

2. A wedge setup/control method for plate material rolling, which reversibly rolls a plate material with a rough mill for hot rolling and performs finish rolling with each stand of a finishing mill, said method comprising:

preparing a wedge meter on an outlet side of a rough mill to measure plate thickness in the direction of the plate width;

measuring, in a final pass of the rough mill, a wedge and the plate thickness at the center of the plate width with the wedge meter, in accordance with distance from the plate leading end, and storing the measured values;

adding a gain to a ratio between the plate thickness at the center of the plate width of each stand of the finishing mill based on a mill setting calculation and the wedge prevailing after control in accordance with time at which the distance from the plate leading end reaches a stand of the finishing mill so that the ratio is equal to a ratio between the stored plate thickness at the center of the plate width on a rough mill side and the wedge;

calculating amount of roll gap leveling control at each stand of the finishing mill using an inheritance coefficient of the wedge, the wedge on an inlet side, and a wedge influence coefficient for roll gap leveling; and applying the amount of roll gap level control to each stand of the finishing mill.

3. The wedge setup/control method for plate material rolling according to claim 2, wherein the wedge and the plate thickness at the center of the plate width are measured over the whole plate length in the final pass of the rough mill and averaged, the amount of roll gap leveling control of each stand of a finishing mill is determined, and the amount of roll gap leveling control is applied to each stand of the finishing mill before finish rolling.

4. A wedge setup/control method for plate material rolling, said method comprising:

preparing a finishing mill that includes a plurality of stands and a wedge meter on an outlet side of the finishing mill to measure plate thickness in the direction of plate width;

entering the plate thickness at the center of the plate width on an outlet side of each stand of the finishing mill in accordance with a mill setting calculation to measure a wedge;

adding a gain to a ratio between the wedge prevailing after individual stand control and the plate thickness at the center of a plate so that the ratio is equal to a ratio between the wedge measured and the plate thickness at the center of the plate width on the outlet side of the last stand;

determining amount of roll gap level control of each stand in accordance with an inlet side wedge prevailing after each stand of the finishing mill is controlled, an inheritance coefficient of the wedge, and a wedge influence coefficient for roll gap leveling;

applying the amount of roll gap level control determined to a first stand of the finishing mill;

tracking an on-plate point of the first stand to which the amount of roll gap level control is applied;

applying the amount of roll gap level control sequentially to the same point for the remaining stands;

measuring the next wedge and the plate thickness at the center of the plate width when the same point reaches the wedge meter; and exercising control repeatedly in the same manner.

5. The wedge setup/control method for plate material rolling according to claim 4, wherein the amounts of roll gap leveling control determined for the stands are simultaneously applied to the stands of the finishing mill.

6. The wedge setup/control method for plate material rolling according to claim 4, wherein the wedge measurements made for the whole plate length are averaged, the obtained average value is used to calculate the amount of roll gap leveling control for each stand of the finishing mill, and the amount of roll gap leveling control is applied to each stand of the finishing mill before rolling of the next plate material.

* * * * *